US007441384B2

(12) United States Patent
Miller et al.

(10) Patent No.: US 7,441,384 B2
(45) Date of Patent: Oct. 28, 2008

(54) PRE-GLUED TONGUE AND GROOVE FLOORING

(75) Inventors: Robert J. Miller, Dalton, GA (US); Gregory Fowler, Rocky Face, GA (US); Benny Ray Wood, Rome, GA (US); Kirk T. Lowe, Knoxville, TN (US)

(73) Assignee: Columbia Insurance Company, Omaha, NE (US)

( * ) Notice: Subject to any disclaimer, the term of this patent is extended or adjusted under 35 U.S.C. 154(b) by 1101 days.

(21) Appl. No.: 10/219,938

(22) Filed: Aug. 14, 2002

(65) Prior Publication Data

US 2004/0031226 A1 Feb. 19, 2004

(51) Int. Cl.
*E04B 5/02* (2006.01)

(52) U.S. Cl. ..... 52/589.1; 52/745.21; 52/591.5; 52/591.1

(58) Field of Classification Search ..... 52/589.1, 52/588.1, 591.5, 591.1, 745.21, 746.1
See application file for complete search history.

(56) References Cited

U.S. PATENT DOCUMENTS

| | | | | |
|---|---|---|---|---|
| 2,882,714 | A | 4/1959 | Gagle et al. | |
| 2,976,203 | A | 3/1961 | Young et al. | |
| 2,976,204 | A | 3/1961 | Young et al. | |
| 3,252,258 | A * | 5/1966 | Blickman et al. | 52/582.1 |
| 3,518,800 | A | 7/1970 | Tank | |
| 3,548,559 | A | 12/1970 | Levine et al. | |
| 3,554,850 | A | 1/1971 | Kuhle | |
| 3,579,941 | A | 5/1971 | Tibbals | |
| 3,625,807 | A | 12/1971 | Beemer | |
| 3,694,983 | A | 10/1972 | Couquet | |
| 3,713,264 | A | 1/1973 | Morgan, Jr. | |
| 3,770,536 | A | 11/1973 | Haigh | |
| 3,900,644 | A | 8/1975 | Sackoff et al. | |
| 3,926,879 | A | 12/1975 | Fourier et al. | |
| 3,988,187 | A | 10/1976 | Witt et al. | |
| 4,018,732 | A | 4/1977 | Lakshmanan | |
| 4,037,377 | A | 7/1977 | Howell et al. | |
| 4,057,527 | A | 11/1977 | Columbus | |

(Continued)

FOREIGN PATENT DOCUMENTS

| | | |
|---|---|---|
| DE | G 9413059 | 11/1994 |

(Continued)

OTHER PUBLICATIONS

Adhesive & Sealant Compound Formulations p. 35-36, author, publication date, and publisher unknown.

(Continued)

*Primary Examiner*—Phi Dieu Tran A
(74) *Attorney, Agent, or Firm*—Ballard Spahr Andrews & Ingersoll, LLP

(57) ABSTRACT

The invention provides a new floor covering panel and floor covering system in which the floor covering panels include first and second generally planar surfaces, first and second side edges containing first and second complementary coupling members, respectively, and an adhesive composition selectively applied to at least a portion of at least one of the first and second coupling members. The adhesive composition providing the adhesive bond may be applied to at least one of the first or second coupling members during the floor covering manufacturing process. After a floor covering system is assembled, the adhesive composition provides a substantially non-refastenable bond between mated floor covering panels.

18 Claims, 3 Drawing Sheets

U.S. PATENT DOCUMENTS

| | | | | | |
|---|---|---|---|---|---|
| 4,095,388 | A | | 6/1978 | Breault | |
| 4,242,390 | A | | 12/1980 | Nemeth | |
| 4,280,942 | A | | 7/1981 | Green | |
| 4,307,140 | A | | 12/1981 | Davis | |
| 4,316,351 | A | | 2/1982 | Ting | |
| 4,322,516 | A | | 3/1982 | Wiest et al. | |
| 4,435,939 | A | * | 3/1984 | Hird | 52/582.1 |
| 4,449,342 | A | | 5/1984 | Abendroth | |
| 4,477,622 | A | * | 10/1984 | Sanderson et al. | 524/522 |
| 4,587,152 | A | | 5/1986 | Gleichenhagen et al. | |
| 4,721,748 | A | | 1/1988 | Iovine et al. | |
| 4,769,963 | A | | 9/1988 | Meyerson | |
| 4,783,499 | A | | 11/1988 | Padget et al. | |
| 4,831,077 | A | | 5/1989 | Ball et al. | |
| 4,832,995 | A | | 5/1989 | McLauchlin | |
| 4,840,825 | A | | 6/1989 | Aristodimou | |
| 4,889,884 | A | | 12/1989 | Dust et al. | |
| 4,931,331 | A | | 6/1990 | Owens | |
| 4,960,802 | A | | 10/1990 | DiStefano | |
| 4,975,481 | A | | 12/1990 | Tamm et al. | |
| 4,997,879 | A | | 3/1991 | Weissgerber et al. | |
| 5,062,913 | A | | 11/1991 | Owens et al. | |
| 5,086,599 | A | | 2/1992 | Meyerson | |
| 5,092,095 | A | | 3/1992 | Zadok et al. | |
| 5,190,997 | A | * | 3/1993 | Lindemann et al. | 524/44 |
| 5,208,086 | A | | 5/1993 | Owens | |
| 5,216,861 | A | | 6/1993 | Meyerson | |
| 5,236,778 | A | | 8/1993 | Landis et al. | 428/282 |
| 5,264,467 | A | | 11/1993 | DiStefano | |
| 5,286,545 | A | | 2/1994 | Simmons, Jr. | |
| 5,292,842 | A | | 3/1994 | Yang | |
| 5,295,341 | A | | 3/1994 | Kajiwara | |
| 5,300,554 | A | | 4/1994 | Krell et al. | |
| 5,314,554 | A | | 5/1994 | Owens | |
| 5,314,944 | A | | 5/1994 | Chao | |
| 5,344,700 | A | | 9/1994 | McGath et al. | |
| 5,389,724 | A | * | 2/1995 | LaFleur | 525/57 |
| 5,401,343 | A | | 3/1995 | Owens | |
| 5,438,809 | A | | 8/1995 | Ehrich | |
| 5,501,895 | A | | 3/1996 | Finley et al. | 428/194 |
| 5,502,939 | A | | 4/1996 | Zadok et al. | |
| 5,540,025 | A | | 7/1996 | Takehara et al. | |
| 5,543,455 | A | * | 8/1996 | Shah | 524/521 |
| 5,578,363 | A | | 11/1996 | Finley et al. | 428/194 |
| 5,616,400 | A | | 4/1997 | Zhang | |
| 5,618,602 | A | | 4/1997 | Nelson | |
| 5,706,621 | A | | 1/1998 | Pervan | |
| 5,730,485 | A | * | 3/1998 | Sjostedt et al. | 296/184.1 |
| 5,830,319 | A | * | 11/1998 | Landin | 162/159 |
| 5,860,267 | A | | 1/1999 | Pervan | |
| 5,950,389 | A | * | 9/1999 | Porter | 52/586.1 |
| 5,952,420 | A | | 9/1999 | Senkus et al. | |
| 5,962,564 | A | | 10/1999 | Braud et al. | |
| 5,968,625 | A | | 10/1999 | Hudson | |
| 5,977,242 | A | * | 11/1999 | Origuchi et al. | 524/521 |
| 6,001,912 | A | * | 12/1999 | Schneider | 524/388 |
| 6,006,486 | A | | 12/1999 | Moriau et al. | |
| 6,023,907 | A | | 2/2000 | Pervan | |
| 6,029,416 | A | | 2/2000 | Andersson | |
| 6,066,688 | A | | 5/2000 | Samonides, Sr. | |
| 6,075,078 | A | | 6/2000 | Braud et al. | |
| 6,094,882 | A | | 8/2000 | Pervan | |
| 6,101,778 | A | | 8/2000 | Mårtensson | |
| 6,182,410 | B1 | | 2/2001 | Pervan | |
| 6,205,639 | B1 | | 3/2001 | Pervan | |
| 6,207,757 | B1 | | 3/2001 | Obrecht et al. | |
| 6,233,896 | B1 | * | 5/2001 | Coup | 52/586.1 |
| 6,248,815 | B1 | | 6/2001 | Papsin et al. | |
| 6,269,608 | B1 | * | 8/2001 | Porter | 52/794.1 |
| 6,290,801 | B1 | * | 9/2001 | Krampe et al. | 156/289 |
| 6,314,701 | B1 | | 11/2001 | Meyerson | 52/588.1 |
| 6,324,803 | B1 | | 12/2001 | Pervan | |
| 6,324,809 | B1 | | 12/2001 | Nelson | |
| 6,352,657 | B1 | * | 3/2002 | Veldhuis et al. | 264/45.8 |
| 6,363,677 | B1 | | 4/2002 | Chen et al. | |
| 6,397,547 | B1 | | 6/2002 | Mårtensson | |
| 6,401,415 | B1 | | 6/2002 | Garcia | |
| 6,413,618 | B1 | | 7/2002 | Parker et al. | |
| 6,418,683 | B1 | | 7/2002 | Martenssen et al. | |
| 6,421,970 | B1 | * | 7/2002 | Martensson et al. | 52/282.1 |
| 6,446,405 | B1 | | 9/2002 | Pervan | |
| 6,505,452 | B1 | * | 1/2003 | Hannig et al. | 52/582.1 |
| 6,591,568 | B1 | * | 7/2003 | Pålsson | 52/592.2 |
| 6,599,599 | B1 | | 7/2003 | Buckwater et al. | 428/40 |
| 6,673,177 | B2 | | 1/2004 | Buckwalter et al. | 156/71 |
| 6,682,254 | B1 | * | 1/2004 | Olofsson et al. | 403/375 |
| 2001/0029716 | A1 | | 10/2001 | Schnabel et al. | |
| 2001/0034991 | A1 | | 11/2001 | Martensson et al. | |
| 2002/0016433 | A1 | | 2/2002 | Keller et al. | 528/10 |
| 2002/0031646 | A1 | | 3/2002 | Chen et al. | |
| 2002/0081410 | A1 | | 6/2002 | Buckwalter et al. | 428/40.1 |
| 2002/0100231 | A1 | | 8/2002 | Miller et al. | |
| 2002/0127374 | A1 | * | 9/2002 | Spratling | 428/192 |
| 2003/0003258 | A1 | * | 1/2003 | Durso et al. | 428/53 |
| 2003/0033777 | A1 | * | 2/2003 | Thiers et al. | 52/390 |
| 2004/0031226 | A1 | * | 2/2004 | Miller et al. | 52/588.1 |

FOREIGN PATENT DOCUMENTS

| | | | | | |
|---|---|---|---|---|---|
| DE | 29610462 | U1 | | 10/1996 | |
| DE | 29703962 | U1 | | 6/1997 | |
| DE | 19651149 | | | 6/1998 | |
| DE | 10022246 | A1 | | 11/2001 | |
| DE | 10141791 | | * | 3/2003 | 52/589.1 |
| EP | 0123136 | | | 10/1984 | |
| EP | 0246856 | | | 11/1987 | |
| EP | 0321868 | A2 | | 6/1989 | |
| EP | 0315070 | B1 | | 12/1990 | |
| EP | 1 043 150 | | | 7/2000 | |
| EP | 1262609 | A1 | | 12/2002 | |
| GB | 812671 | | | 4/1959 | |
| GB | 2117813 | | | 10/1983 | |
| GB | 2142670 | A | | 1/1985 | |
| GB | 2168732 | A | | 6/1986 | |
| GB | 2243381 | | | 10/1991 | |
| JP | 3169967 | | | 7/1991 | |
| JP | 4-238956 | | | 8/1992 | |
| JP | 238956 | | * | 8/1992 | 52/578 |
| JP | 5-163816 | | | 6/1993 | |
| JP | 163816 | | * | 6/1993 | 52/582.1 |
| JP | 6-88414 | | | 3/1994 | |
| JP | 88414 | | * | 3/1994 | 52/582.1 |
| JP | 6-136911 | | | 5/1994 | |
| JP | 6-146532 | | | 5/1994 | |
| JP | 6-146561 | | | 5/1994 | |
| JP | 136911 | | * | 5/1994 | 52/582.1 |
| JP | 146531 | | * | 5/1994 | 52/582.1 |
| JP | 146532 | | * | 5/1994 | 52/582.1 |
| JP | 6-193226 | | | 7/1994 | |
| JP | 193226 | | * | 7/1994 | 52/582.1 |
| JP | 232449 | | * | 9/1996 | 52/589.1 |
| JP | 260678 | | * | 10/1996 | 52/589.1 |
| WO | WO 79/01149 | | | 12/1979 | |
| WO | WO 91/05929 | | | 5/1991 | |
| WO | WO 00/06854 | | | 2/2000 | |
| WO | WO 01/43925 | | | 6/2001 | |
| WO | WO 02/055810 | A1 | | 7/2002 | |
| WO | WO 02/075074 | A1 | | 9/2002 | |
| WO | WO 03/012224 | A1 | | 2/2003 | |
| WO | WO 03/048481 | A1 | | 6/2003 | |

OTHER PUBLICATIONS

Petrie, Edward M., "Adhesive Classifications", *Handbook of Adhesives and Sealants,* McGraw-Hill, 2000 (p. 301).

Nicholsen, "Vinyl: State-of-the-Industry," *Floor Covering Weekly,* vol. 50, No. 26, Oct. 2001 (1 pg).
Brochure: "EdgeMaster Laminate Edge Sealing System, Cal-Flor Accessory Systems" (8 pgs).
Amstock, Joseph S., "Flourocarbons and Hot Melt Adhesives and Sealants," *Handbook of Adhesives & Sealants in Construction,* McGraw Hill, 2001 (pp. 5.2-5.4).
Ash, Michael & Irene, "Specialty Adhesives," *Formulary for Adhesives and Other Sealants* Chemical Publishing Co., Inc., New York, New York, 1987 (p. 286).
Amstock, Joseph S., "Formulary for Sealants and Adhesives," *Handbook of Adhesives & Sealants in Construction,* McGraw Hill, 2001 (p. 17.5).
Amstock, Joseph S., "Introduction to Sealants & Adhesives, " *Handbook of Adhesives & Sealants in Construction,* McGraw Hill, 2001 (pp. 1.17-1.18).
Pina, Raymond, "Dri-Glu to the Rescue?" *Laminates,* Industry Trade Article (1 pg.).
Brochure: *The Beauty and Quality of Laminate Floors,* Panda Products, Inc. Cartersville, Georgia (28 pgs.).
Unidyne TG-472 Technical Information, Daikin America, Inc., Orangeburg, New York (8 pgs.).
"Water Repellant Laminate Flooring Joint With Underlayment" Article, Vantage Flooring System (pp. 1-5 and Figures).
Whitehouse, R.S., "Review of Contact Adhesive Development," *Critcal Reports on Applied Chemistry, Synthetic Advesives and Sealants,* vol. 16, Edited by W.C. Wake, John Wiley & Sons, 1987 (pp. 2-3).
Wiltgen, Ronald E., "Flourochemicals: Functional Finished for the Textile Industry," Tenth Latin American Conference of Textile Chemists, Oct. 1985, Buenos Aires, Argentina (pp. 1-14 and Appendices).
Supplemental European Search Report for European Application No. 02775705, mailed Nov. 13, 2006.

* cited by examiner

PRE-GLUED TONGUE AND GROOVE FLOORING

BACKGROUND OF THE INVENTION

1. Field of the Invention

This invention relates generally to floor covering panels for use in commercial, industrial or residential environments. More particularly, this invention relates to a floor covering panel having complementary coupling members with an adhesive composition applied to at least one location on at least one coupling member, where the adhesive composition may be pre-applied to the floor covering panel.

2. Background Art

It is generally known in the art to use various laminates, including high pressure laminates and fiberboard core laminates, in flooring applications. Fiberboard core laminates used to manufacture flooring products typically include a plurality of layers, including a fiberboard or organic composite core layer, a decorative layer, and a hard and flat protective wear layer of resin-impregnated melamine material. These layered constructions are typically formed into standard sized panels which are joined together at an installation site to create a floor covering system.

Further, in recent years, there has been a movement away from the use of wall-to-wall carpeting in residential and commercial establishments. Instead, interior decorators have been moving toward using more "traditional" designs, which include hardwood flooring. Such hardwood flooring generally comprises a tongue and groove design.

Some prior art floor covering panels use a tongue and groove coupling joint with a liquid adhesive applied to the coupling joints by the installer just prior to assembly. While a liquid adhesive may enhance the bond between the panels, the installation process can be slow and unreliable because it may be difficult to control the amount of glue dispensed. Furthermore, when the panels are installed, excess glue may squeeze Out of the joint and onto the visible surface or underside of the panels.

To address this problem, some manufacturers have developed coupling profiles in which an interference fit or snap-locking fit is provided and intended to urge the panels together and maintain panel-to-panel connection without the use of adhesives. These designs generally provide an easier installation process. However, they can create problems relating to the integrity of the joint. For example, the mechanical locking mechanisms may wear over time thereby reducing the locking force and resulting in play and visible gaps between the panels. Furthermore, the strength of some such joints may be noticeably less than that of products having adhesive applied within the joints.

In light of the above, a need exists in the industry for a floor covering panel and a floor covering panel system having strong and reliable joints. Additionally, a need exists for a floor covering panel and a floor covering panel system having an adhesive composition within the joint that need not be applied during installation of the floor coving panel system, but rather may be pre-applied in the desired amount, and at the desired locations thereon.

SUMMARY OF THE INVENTION

In accordance with the invention, as embodied and described herein, this invention, in one aspect, relates to a floor covering panel. In this aspect, the invention includes a first generally planar surface and a second generally planar surface opposed to the first surface. Between the first and second surfaces are a first side edge and an opposed second side edge, respectively. Within the first edge of the panel is a first coupling member, which includes a protrusion extending therefrom. A complementary second coupling member is defined within the second edge of the panel and includes a recess sized and shaped to receive the first protrusion therein. An adhesive composition is selectively applied to at least a portion of at least one of the first and second coupling members.

In use, a first coupling member of a first panel is received within a second coupling member of a second panel such that the adhesive composition is positioned between the respective first and second coupling members of the two panels. An adhesive bond is thereby formed between the two coupling members. A plurality of panels may be joined together in this manner to form a floor covering system.

In particular, the adhesive composition providing the adhesive bond may be selectively applied to at least one of the first or second coupling members during the floor covering panel manufacturing process. Still further, the adhesive composition provides a substantially non-refastenable bond that results in a durable bond between mated floor covering panels.

Additional advantages of the invention will be set forth in part in the description which follows, and in part may be learned from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE INVENTION

The present invention is more particularly described in the following examples that are intended as illustrative only since numerous modifications and variations therein may be apparent to those skilled in the art. As used in the specification and in the claims, "a," "an," and "the" can mean one or more, depending upon the context in which it is used. Several aspects of the present invention are now described with reference to the figures, in which like numbers indicate like parts throughout the figures.

Figure 1:
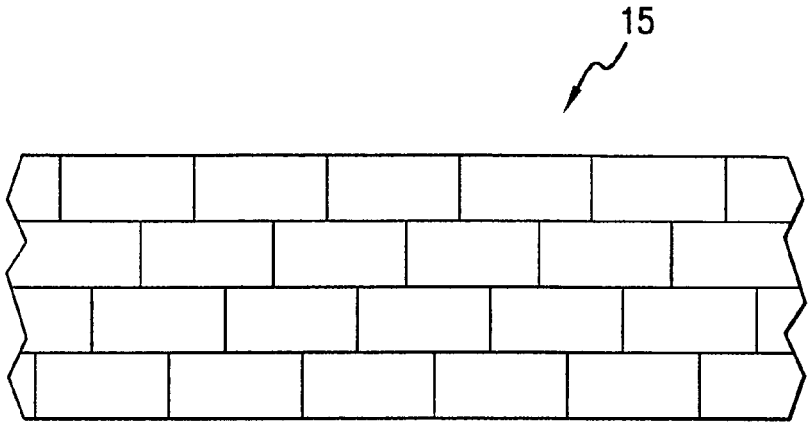
FIG. 1 is a top plan view of a plurality of floor covering panels connected together to form a floor covering panel system.
Figure 2:
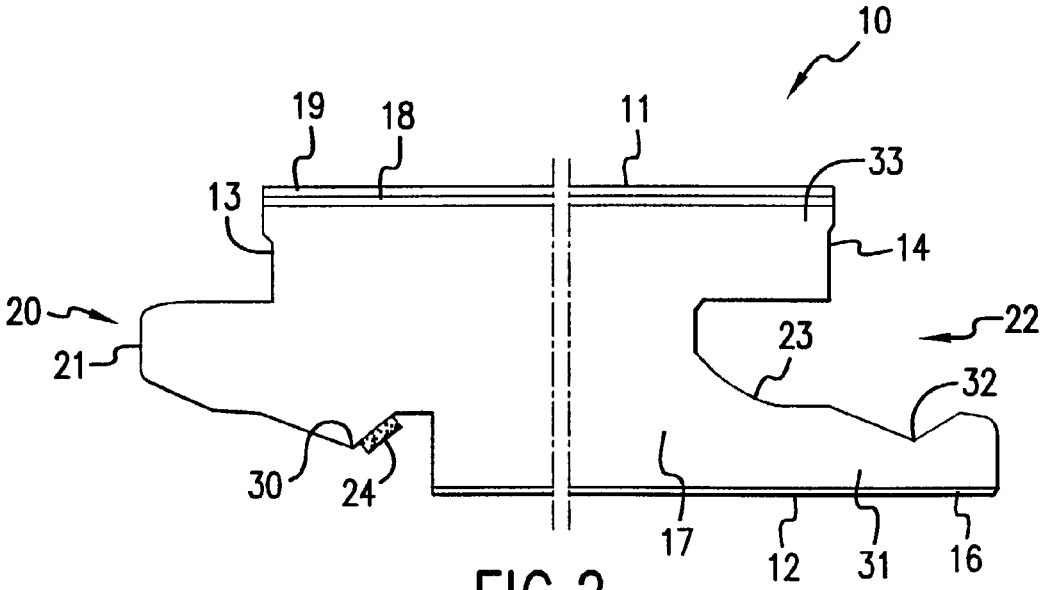
FIG. 2 is a cross-sectional side view of an embodiment of the floor covering panel according to the present invention.

Referring to FIGS. 1 and 2, the present invention, in one embodiment, is a floor covering panel 10. The panel 10 includes a first generally planar surface 11 and a second generally planar surface 12 opposed to the first surface. Extending between the surfaces 11, 12 are a first side edge 13 and an opposed second side edge 14, respectively, each of which runs the length of the floor covering panel. Defined within the first side edge 13 is a first coupling member 20, which includes a protrusion 21 extending therefrom. The second side edge 14 includes a second complementary coupling member 22 defined therein that includes a recess 23 sized and shaped to receive the protrusion 21 of a second one of the floor covering panels therein. An adhesive composition 24, described in greater detail below, is selectively applied to at least a portion of at least one of the first or second coupling members 20, 22, as desired. A plurality of floor covering panels may be joined together to form a floor covering system 15 as shown in FIG. 1.

The present invention includes floor covering panels of various constructions known in the industry or that may be developed in the future. For example, the floor covering panels may be manufactured from a laminated material having a fiberboard core. Additionally, the present invention may be constructed of other types of laminates such as high pressure laminates, which have been marketed under such trade names as Formica® and Wilson Art®. Other materials may also be used to construct the floor panel such as natural organic, recycled or synthetic materials. Still further, the floor covering panel may be a tongue and groove wooden flooring material, such as those manufactured by Bruce Hardwood Floors, a division of Armstrong Flooring, Inc (Lancaster, Pa.) Still further, the present invention is suitable for use on any flooring substrate that will benefit from inclusion of a non-refastenable bond as set forth in more detail herein.

Referring to FIG. 2, a typical laminate floor panel is constructed of a plurality of discrete layers, which may include some or all of the following: a backing layer 16, a core layer 17, a decorative layer 18, and a wear layer 19. The various layers may be adhered, joined, or coupled to one another by a chemical adhesive, mechanical connection, or other means known in the art for forming the panel. In an embodiment including each of the above listed layers, the first generally planar surface 11 is usually the upper surface of the wear layer 19 while the second generally planar surface 12 is typically created by the lower surface of the backing layer 16 as shown in FIG. 2. When the panel 10 is installed, the backing layer 16 faces the underlying subfloor (not shown).

While the backing layer 16 is optional, it may provide an improved moisture resistance to the floor panel 10 because the core layer 17 typically is not completely impervious to moisture or contaminants. Additionally, the backing layer 16 may improve the structural integrity of the floor panel 10 by increasing overall thickness and reducing the warp and wear tendencies of the uncoated core material. The construction of the backing layer 16 may, for example, comprise a clear sheet of melamine reinforced with aluminum oxide ($AlO_2$) and impregnated with a suitable thermosetting resin. In other embodiments, backing layers 16 may be constructed of other materials providing suitable moisture resistance, such as phenolic resins or other natural, synthetic or recycled materials.

The next layer in a typical laminate floor covering panel is the core layer 17. In one embodiment, the core layer 17 may be formed from medium density or high density fiberboard, such as those marketed by companies including Louisiana Pacific, Georgia Pacific, Temple Inland, and Weyerhauser. One fiberboard core material found to produce acceptable results is a high density fiberboard, which is a hardwood/softwood fiber compound compressed at 900-960 kg/m$^3$. Such fiberboard core material is usually available in 4 or 5 feet (1.22 or 1.52 meters) widths and lengths of up to 18 feet (5.49 meters). In other embodiments, core layers 17 constructed of different materials or having different properties may be utilized, including but not limited to other timber-based products, such as plywood, chipboard or particleboard.

In one embodiment, the decorative or "décor" layer 18 comprises a sheet of paper that substantially covers the top surface of the core layer 17. The visible side of the decorative layer 18 displays a desired aesthetic appearance, such as a color or pattern. For example, some currently contemplated patterns include simulated hardwood flooring and simulated ceramic tile, each in a variety of styles, shades and colors. Currently contemplated simulated hardwood styles include pine, heart pine, cherry, maple, beech, oak and mahogany. Simulated tile appearances are contemplated in a range of styles, including a variety of marble and ceramic tile colors, including grout lines in ceramic tile styles. Other currently contemplated patterns include floral patterns, abstract designs, geometric designs and company logos. Other patterns may be selected by the manufacturer or user according to their aesthetic preferences or design objectives.

The decorative layer 18 may be manufactured from paper that is impregnated with a thermosetting resin and provided with the desired aesthetic color and/or pattern. Other materials may make up the decorative layer 18, such as real wood veneer, pulverized stone, or other materials. Additionally, it is possible to achieve a similar decorative appearance by applying a direct or indirect printing process onto the top surface of the core layer 17. In such an embodiment, the decorative layer 18 comprises the ink, dye, pigment or other marking substances applied to the core layer 17. Alternatively, the decorative appearance may be provided by etching, burning or otherwise marring the top surface of the core layer 17. Any such treatment that supplies such a decorative appearance on the top surface of the core layer 17 is contemplated to comprise the decorative layer 18 as defined herein. Alternatively, a decorative appearance may be imparted directly to the upper surface of the wear layer 19, which may remove the need for a decorative layer 18 within the floor panel 10.

The wear layer 19 may be adhered, joined, or coupled to the decorative layer 18 to protect the panel from the ambient environment. In one embodiment, the wear layer 19 is substantially transparent so that the aesthetic appearance of the decorative layer 18 is unobstructed by the wear layer 19. Though a wear layer 19 is optional, the resistance of the floor panel 10 to wear, staining or fading of the aesthetic image imparted to the decorative layer 18 may be generally improved by the inclusion of a wear layer 19 in the floor covering panel 10. The wear layer 19 may comprise a melamine sheet, which is reinforced with $AlO_2$ and impregnated with a thermosetting resin. Alternately, the wear layer 19 may comprise a layer of varnish or other UV curable scratch resistant coating Moreover, the wear layer 19 may be made from any material providing suitable moisture resistance and resilience to loads and wear to which a floor is subjected, such as phenolic resins or other natural, synthetic or recycled materials.

Figure 3:
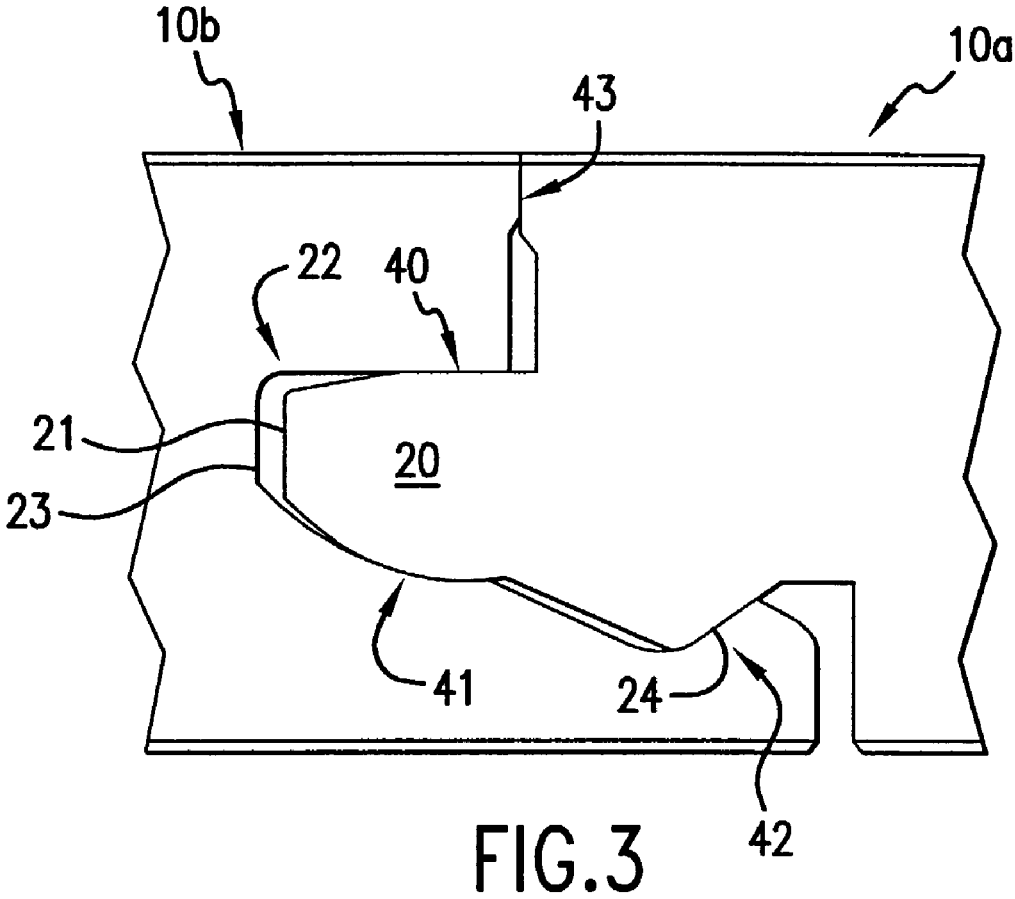
FIG. 3 is a partial cross-sectional side view of a pair of the floor covering panels of FIG. 2, particularly illustrating a first coupling member engaging a second coupling member.

The coupling members 20 and 22 of the present invention provide a means for joining two adjacent floor covering panels 10*a*, 10*b* together as illustrated in FIGS. 1 and 3. One non-limiting example of such a means for adjoining adjacent panels is set forth in U.S. Pat. No. 6,006,486 to Moriau et al. (which is incorporated herein in its entirety by the reference).

In the embodiment illustrated in FIGS. 2 and 3, the first edge 13 of the panel 10 includes the first coupling member 20. The first coupling member 20 includes a protrusion 21 with a rib 30 formed on the underside thereof. On the second edge 14, the second coupling member 22 includes an upper lip 33, a lower lip 31, and a detent 32 formed within the lower lip 31. The recess 23 is sized and shaped to accept the protrusion 21, and the detent 32 is sized and shaped to accept the rib 30. In this embodiment, the detent 32 and the rib 30 represent a locking structure, which will be discussed in greater detail below.

Referring to FIGS. 2 and 3, the coupling of floor covering panel 10*a* to adjacent panel 10*b* is achieved by placing the first coupling member 20 of panel 10*a* into the second coupling member 22 of panel 10*b*. In the illustrated embodiment, the tip of the protrusion 21 of panel 10*a* must be inserted into the recess 23 of panel 10*b* at an angle above the horizontal, and the panel 10*a* must then be rotated clockwise until the panels 10*a* and 10*b* are within substantially the same horizontal plane, as illustrated.

In the illustrated embodiment, contact is made between the complementary coupling members 20, 22 of the two panels 10*a*, 10*b* in four contact zones as shown in FIG. 3. The protrusion 21 of panel 10*a* contacts the upper lip 33 and the lower lip 31 of panel 10*b* at zones 40 and 41, respectively. Contact zones 40 and 41 help locate the panels into substantially the same horizontal plane. The rib 30 (FIG. 2) of panel 10*a* engages the detent 32 of panel 10*b* at contact zone 42. In this embodiment, the contact zone 42 is substantially planar; however, any contact zone may be formed in any shape depending on the profile desired. The angle formed by the substantially planar contact zone 42 and the substantially planar second surface 12 forms an acute angle therebetween, when measured from the second surface 12 counterclockwise to the plane of the contact zone 42. This configuration ensures that the contact force between the adjacent panels 10*a*, 10*b* at the contact zone 42 urges the panels together and promotes a tight joint. This locking structure defined by the rib 30 of panel 10*a* and the detent 32 of panel 10*b* prevents substantial separation of the two panels 10*a* and 10*b* in a direction perpendicular to the side edges 13, 14 of the panels 10*a*, 10*b* and parallel to the respective first surfaces 11. An additional contact zone 43 is present in the embodiment illustrated in FIG. 3, adjacent the first surface 11 of each of the panels 10*a*, 10*b*.

It should be noted that floor covering panels 10 may be manufactured in a variety of shapes and sizes, commonly including square, rectangular and other polygonal embodiments. In the case of square and rectangular panels, each panel has four side edges. Thus, according to the invention, each panel 10 may include two first side edges 13, and two opposed second side edges 14, each edge extending between the top and bottom surfaces 11, 12 of the panel 10.

It should also be noted that the embodiments shown in FIGS. 2 and 3 are for illustrative purposes only, and that the present invention is equally applicable to other coupling profiles known in the industry or that may be developed in the future. In other embodiments, the quantity, size and location of the contact zones may vary with the profile as desired, but the different profiles still fall within the scope of the present invention. For example, a tongue and groove profile without a locking structure would benefit from, and fall within the scope of the present invention. As a further example, a tongue and groove profile in which substantially full contact is maintained along the entire mating edges of the panels is also contemplated as being within the scope of the invention.

The adhesive composition 24 may be selectively pre-applied at the factory, at any desired location and in any desired amount, using one of a number of methods known to one of skill in the art. In one illustrative example, the adhesive composition may be applied in spray form or in a bead form at the desired location. According to the present invention, the adhesive composition 24 may be selectively applied to at least a portion of at least one of the first or second coupling member 20, 22 as desired, for example the contact zones 40-43. Still further, the adhesive composition 24 may be selectively applied to at least a portion of the first coupling member 20. Yet still further, the adhesive composition 24 may be selectively applied to at least a portion of the second coupling member 22. In a still further aspect, an adhesive composition 24 may be selectively applied to at least a portion both the first and the second coupling member 20, 22, which portions may correspond with, or be separate of, one another as desired.

In the embodiment shown in FIGS. 2 and 3, the adhesive composition 24 may be selectively applied only to the rib 30 at a location corresponding to the contact zone 42. By "selectively applied" it is meant that the adhesive composition 24 is applied only to the intended area of application, and that the adhesive composition 24 is not applied to neighboring areas or any other areas besides the selected and intended area of application. When adjacent panels 10*a*, 10*b* are assembled together as illustrated in FIG. 3, the adhesive composition 24 forms an adhesive bond between the rib 30 and the detent 32. In another embodiment, the adhesive composition 24 may be selectively applied only to the detent 32 at a location corresponding to the contact zone 42. In yet another embodiment, the adhesive composition 24 may be selectively applied to both the rib 30 and the detent 32 at a location corresponding to the contact zone 42.

In other embodiments, the adhesive composition 24 may be applied to locations on one or both of the coupling members 20, 22 and at locations corresponding to some or all contact zones for that particular coupling profile. As set forth above, in various embodiments, the adhesive composition 24 may be selectively applied only to locations on the first coupling member 20 corresponding to one or more contact zones. Alternatively, the adhesive composition 24 may be selectively applied only to locations on the second coupling member 22 corresponding to one or more of the described contact zones. In yet another embodiment, the adhesive composition 24 may be selectively applied to locations on both the first coupling member 20 and the second coupling member 22 corresponding to one or more contact zones, as desired.

In yet a further embodiment, the adhesive composition 24 may be applied to substantially the entire first edge 13, second edge 14, or both, as desired.

Various methods can be used for applying the adhesive composition 24 to the floor covering panels 10, as are known. In a first aspect, a vacuum coating process may be utilized. In this aspect, a floor covering panel is passed through a machine that applies the adhesive composition under pressure to one side of a respective edge of a floor covering panel. A vacuum is applied at an opposite side of the edge of the panel to remove excess adhesive composition from the floor covering panel. Excess adhesive composition may be returned to a vessel for re-use. Use of such a vacuum coating method allows for precise application of the adhesive coating to a floor covering panel by way of adjusting the pressure/vacuum ratios.

A further method that may be utilized to apply the adhesive coating composition to the floor covering panel is the use of a roll coat applicator. In this method, several large diameter rollers are made to match the area to be coated on the floor covering panels. The adhesive composition may be applied to the floor covering panels by a transfer roller that is supplied with an adhesive composition from a supply reservoir. The application of the adhesive composition can be precisely controlled by adjusting the parameters used in the application.

A further method of applying the adhesive composition to the floor covering panels is achieved by use of a multi-spray head applicator. This method will allow application of the adhesive composition to the flooring profile with precision and accuracy. In this method, multiple spray applicators may be fitted with nozzles and be situated to spray the adhesive composition on selected portions of the side edges of a floor covering panel. The spray applicators may pulse at a high frequency to apply the adhesive composition to the desired position on the floor covering panel, which pulsing action may also assist in keeping the spray head clean. The adhesive composition is supplied to the spray head by means of a conventional pump system that pulls the composition from a supply tank. Such spray application systems are known to those skilled in the art and are commercially available from manufacturers including Nordson Corp. (Westlake, Ohio), ITW Dynatec America (Hendersonville, Tenn.) and 3M Corp. (St. Paul, Minn.).

Other methods of applying the adhesive composition 24 may be utilized according to the invention, including other existing methods of applying the adhesive composition, and including methods of applying the adhesive composition that may be developed in the future.

Application weights for the adhesive composition may be from about 0.1 to about 2.0 g of adhesive per 48" board. Still further the adhesive application weight may be from about 0.1, 0.2, 0.4, 0.5, 0.7, 0.9, 1.0, 1.2, 1.5, 1.9, or 2.0 g per 48" (1.22 meters) board. From about 1 to about 4 beads of adhesive may be applied along the board edges.

The main ingredient of the adhesive composition may comprise one or more acrylic latex polymers or other similar polymers. Such materials are described in detail in U.S. Pat. No. 4,477,622, the disclosure of which is incorporated herein in its entirety by this reference. Other suitable materials for use as the adhesive composition are described in U.S. Pat. No. 6,290,801 B1, the disclosure of which is also incorporated herein in its entirety by this reference.

In further aspects, the main ingredient for the adhesive composition may comprise one or more of: polychloroprene, polyurethane, styrene-isoprene copolymer, styrene-butadiene copolymer, polyimide, polyvinyl chloride, nitrocellulose, polyisoprene, acrylonitrile-butadiene-isoprene terpolymer, butadiene-methacrylonitrile copolymer or polyethylene-vinyl acetate copolymer.

In a further aspect, the adhesive composition comprises an acrylic polymer that is derived from one or more monomers comprising: methyl acrylate, ethyl acrylate, butyl acrylate, cyclohexyl acrylate, 2-ethylhexyl acrylate, t-octyl acrylate, dodecyl acrylate, and octadecyl acrylate In one particular aspect of the present invention, the polymer used in the adhesive composition comprises a vinyl acrylic polymer blend with one of the acrylic polymers having a Tg of about 20 to about 40° C., or from about 25 to about 35° C., and the second acrylic polymer having a Tg of from about 10 to about 30° C., or from about 15 to about 25° C. The blend of first and second acrylic polymers comprises from about 50 to about 70% by total weight polymer of first acrylic polymer and from about 50 to about 70% by total weight polymer of the second acrylic polymer. The first and second acrylic polymers in this mixture comprise from about 1 to about 8 moles of alkyl esters of acrylic acid and a fully hydrolyzed poly(vinyl) alcohol that is about 60 to about 80 percent hydrolyzed. A specific commercially available form of this polymer blend is supplied by Advance Adhesive Technologies, Inc. (Dalton, Ga.) as "AAT-1311-3".

A further polymer blend that is suitable for use in the adhesive composition of the present invention is a blend of the AAT-1311-3 discussed above and an ethylene-vinyl acetate copolymer ("EVA") and an acrylic latex. The Tg of the EVA polymer is from about −10 to about +10° C. or from about −5 to about +5° C. The ethylene monomer is from about 15 to about 30% by weight and the vinyl acetate is from about 85 to about 70% by weight. The acrylic polymer has a Tg of from about 30 to about 40° C. and comprises an ester of acrylic acid or methacrylic acid and an alcohol. The carbon length may be from about 6 to about 20 carbon atoms, or from about 6 to about 12 carbon atoms, or from about 8 to about 10 carbon atoms. This particular polymer blend is supplied commercially as "AAT-1311-4," by Advanced Adhesives Technologies.

The adhesive composition may contain other materials known to one of ordinary skill in the art. Such additives will vary depending on the final properties desired in the adhesive composition and the adhesive bond formed therefrom. In non-limiting examples, the adhesive composition may contain viscosity modifiers, rheology modifiers, fillers, opacifiers, preservatives and surface tension modifiers.

In one aspect, after application to the floor covering panel, the adhesive composition may be essentially non-tacky. In some circumstances, a non-tacky adhesive composition may be desirable so that lint, dust and other materials will be less likely to adhere to the adhesive composition prior to installation. As would be recognized by one of ordinary skill in the art, the adherence of lint, dust, and the like can be unsightly and can also reduce the adhesive effectiveness of the adhesive composition.

In one aspect, the tackiness of an adhesive composition may be regulated by combining two or more adhesive polymers, as found with the AAT-1311-3 and 1311-4 compositions described above. For example, a "soft" polymer will give an adhesive composition adhesive properties but will also generally be tacky. In contrast, a "hard" polymer will not be tacky, but will also generally not provide substantial adhesive properties at temperatures close to ambient. By mixing these two polymer types, the qualities of each polymer may be used to result in an adhesive that is non-tacky, but which provides a strong bond after the application of pressure.

Still further, the tackiness of the adhesive polymer composition may be modified by the addition of tackifiers. Such tackifiers and the uses thereof are well known to those of ordinary skill in the art and, as such, are not discussed in detail herein.

Other suitable acrylic polymers or polymer blends (which may or may not include acrylic polymers) are available from Air Products and Chemicals (Lehigh Valley, Pa.) and Rohm and Haas Co. (Philadelphia, Pa.).

In another aspect, the adhesive compositions suitable for use herein provide a substantially non-refastenable bond. "Substantially non-refastenable" means that upon completion of bond formation, when a force is applied to the panels at the point of adhesion, the floor covering panels will not separate. More specifically, it is more likely for the floor covering panels themselves to break than for the adhesive bond to fail.

In a further embodiment, therefore, the adhesive composition 24 creates a substantially non-refastenable bond between the first coupling member 20 of the first floor covering panel 10*a* and the second coupling member 22 of the second covering panel 10*b* after a desired time period. As would be recognized by one of ordinary skill in the art, the desired properties of the final adhesive composition will depend on the use for which the floor covering is intended. For example, a floor covering panel which is intended for installation by a professional installer may need less "refastening time" than a floor covering panel that is intended for installation by a homeowner. "Refastening time" is used herein to denote the time required for the adhesive composition on a first floor covering panel to form a substantially non-refastenable bond with a second floor covering panel. During all or part of this refastening time, the floor covering panels may be repositioned without damage to the floor covering panels themselves or to the ability of the adhesive composition to ultimately form a durable non-refastenable bond. At the conclusion of the refastening time, it will not be possible to reposition a mated pair of flooring panels without breaking either the adhesive bond or the panels themselves. In this circumstance, failure of either the adhesive bond or the panels themselves is a result that will be unacceptable to the consumer.

In accordance with the present invention, it is also important that the adhesive not form an immediate seal when the floor covering panels are brought together. To the contrary, adhesive compositions utilized in the present invention should allow enough "working time," or refastening time, as described above, to allow the floor covering panels to be shifted to ensure proper alignment of the panels. Put another way, in a significant aspect of the present invention, the adhesive composition will not form a non-refastenable bond immediately upon contact of the two panels.

That is, a professional installer who has significant experience in installing floor covering panels may not need multiple tries to suitably mate a pair of floor covering panels, whereas a homeowner may make one or more mistakes in joining the pair. Thus, the homeowner may need to reposition the floor covering panels one or more times prior to obtaining satisfactory positioning. Accordingly, floor covering panels intended for installation by a professional may comprise an adhesive composition that forms a non-refastenable bond in a shorter period of time than a product that may be intended for installation by an homeowner. In light of the potentially different skill levels of the end-users for the floor covering panels of the present invention, the adhesive compositions and resulting adhesive properties thereof may be adjusted by varying the type of adhesive polymer and the amount thereof. Such variations may be determined by one of ordinary skill in the art without undue experimentation.

In separate aspects, the refastening time of the adhesive composition used on the floor covering panels of the present invention is from about 4 to about 48 hours, or from about 2 to about 12 hours, or from about 12 to about 48 hours, or from about 1 to about 4 hours. Still further, the refastening time for the adhesive composition used on the floor covering panels of the present invention is about 1 hour, about 2 hours, about 5 hours, about 10 hours, about 15 hours, about 20 hours, about 24 hours, about 36 hours or about 48 hours, where any value can be used as an upper or lower endpoint, as appropriate. Still further, the floor covering panels may be adjusted at up to 36 hours, but at about 48 hours, a non-refastenable bond is present, thereby preventing adjustment of the panels without breaking of the adhesive bond.

In separate aspects, after mating of two floor covering panels, a substantially non-refastenable bond is not formed for about 1 hour, about 6 hours, about 12 hours, about 18 hours, about 24 hours, about 36 hours, or about 48 hours, where any value can be used as an upper or lower end point, as appropriate.

The adhesive composition 24 may form a substantially non-refastenable bond when an adhesive applied to corresponding portions of the first coupling member 20 located on the first floor covering panel 10*a* and on the second coupling member 22 located on the second floor covering panel 10*b* are mated. This is an "adhesive to adhesive seal." Alternatively, the adhesive composition may form a substantially non-refastenable bond when the adhesive composition is applied to one of a first floor covering panel 10*a* or a second floor covering panel 10*b* that are mated. This is an "adhesive to panel" seal. As would be recognized by one of ordinary skill in the art, each of these bond types requires that the adhesive composition exhibit suitable adhesion to the floor covering panel material itself. As such, in the present invention, the adhesive compositions utilized herein form a tight bond to the floor covering panel material.

In an alternate aspect, the adhesive composition may have a release strip applied to its surface. When intended for installation by the consumer, this release strip will be removed to present the adhesive composition on one or more floor covering panels for mating thereof.

While it is apparent that the form and ingredients of the adhesive composition used in the present invention may vary significantly according to the intended end use and desired adhesive bond strength, a major aspect of the present invention is that no activator, whether moisture (i.e. water) or otherwise, is needed in order to form the adhesive bond. That is, the adhesive composition used in the present invention is "self-activating" in that it requires no catalyst or activator to commence formation of a substantially non-refastenable bond upon mating of two floor covering panels.

In one aspect, the adhesive composition is aqueous. By "aqueous" it is meant that the primary solvent for the adhesive is water. The adhesive composition may have, in some aspects, a co-solvent, such as an organic solvent material. However, to lessen the environmental impact of the adhesive composition, in most aspects, the solvent in the adhesive composition will be water.

In a further aspect, the adhesive composition may be applied during the floor covering panel manufacturing process at or near ambient temperature. By "ambient" it is meant temperatures that generally range from about 20° C. to about 40° C. In such aspects, the adhesive will be flowable upon application to the floor covering panel. That is, in most aspects, the adhesive composition will not require the application of heat to the adhesive composition to facilitate application to the floor covering panel.

As will be recognized by one of ordinary skill in the art, it may be important that the adhesive composition have a sufficient viscosity at the application temperature so as to not be "runny" upon application to the floor covering panel. To this end, at the application temperature, the adhesive composition should not flow substantially over the floor covering panel prior to fixation. The suitable viscosities and rheological qualities of the adhesive compositions used in the present invention can be readily determined by one of ordinary skill in the art without undue experimentation. Further, should the adhesive composition require modification of the viscosity to facilitate application of the adhesive composition to the floor covering panel, such modification can be effected using methods and materials known to one of ordinary skill in the art. Accordingly, such methods and materials will not be discussed in detail herein. In a further aspect, the adhesive composition is thixatropic.

Upon application to the floor covering panel as discussed in more detail herein, the adhesive composition should become dry to the touch within a fairly short period after application. In one aspect, the adhesive composition may dry, i.e., the solvent will evaporate from the composition, under ambient conditions. Still further, heat may be applied in the manufacturing process to remove the solvent from the composition. Such heating methods may be by infrared lamps, hot air or microwave energy. When any of these drying methods are used, it is desirable that the solvent be evaporated from the adhesive composition in a fairly short period of time so as to facilitate the manufacturing process. Further, as would be recognized by one of ordinary skill in the art, a lesser amount of water (or other liquid) in the adhesive composition will generally result in a shorter drying time for the adhesive composition. Thus, in one aspect, the amount of water in the adhesive polymer should not exceed about 55% by weight.

When the time comes to install the floor covering material, the adhesive composition must be able to form a non-refastenable bond. Since some time may go by between manufacture and installation of the flooring material, the adhesive composition should have a shelf life after application to the flooring material of from several months up to about two years, or a shelf life sufficient to allow for storage, display, sale and eventual use of the flooring material. By "shelf-life" it is meant the period of time for which the adhesive composition will still maintain its adhesive characteristic e.g., the period of time for which the adhesive composition will be suitable for use in durably attaching individual floor covering panels together. "Shelf life" may also be known to one of ordinary skill in the art as "open time." "Open time" means that time span, after the adhesive composition is dried, during which a substantially non-refastenable bond may be obtained between two floor covering panels as described elsewhere herein. However, as one of ordinary skill in the art may recognize, the shelf life of the adhesive composition may vary depending on such matters as, for example, the temperature and humidity at which the laminate flooring material is stored. In general, it is believed that the adhesive capabilities of the composition of the present invention will remain fairly constant for several months to up to two years when shipped and stored under conditions typically found with laminate flooring materials. In separate aspects, the open time for the adhesive compositions suitable in the present invention may be at least about 1 week, about 1 month, about six months, about 1 year, about 1.5 years or about 2 years, where any value can be used as an upper or lower endpoint, as appropriate.

Still further, no special packaging is needed to maintain the desired open time for the adhesive compositions. That is, floor covering panels treated with the adhesive compositions may be stored and shipped at normal temperatures and humidity such that no special refrigeration or humidity controls are necessary when compared to those used to ship the same or similar floor covering panels not treated with adhesive compositions as described in detail herein.

In one aspect, the adhesive composition utilized in the present invention is a "contact adhesive." However, adhesive compositions that bond in a dry state to the floor covering panel substrate to form a substantially non-refastenable adhesive to panel bond as described elsewhere herein are also suitable for use. Still further, the adhesive compositions of the present invention are not pressure sensitive adhesives.

A contact adhesive is an adhesive that will bond to itself by a diffusion process. This diffusion process is referred to herein as "cold flow." Without being bound by theory, it is believed that this delayed setting action of the adhesive compositions suitable for use herein is a result of a cold flow action of the adhesive composition. Such cold flow adhesion will occur when pressure is applied to the adhesive composition, as would occur when a first floor covering panel 10*a* having an adhesive composition applied is mated (using at least some pressure) with a second floor covering panel 10*b*. Upon commencement of cold flow (or "autohesion"), the adhesive composition will begin to form a substantially non-refastenable bond between the first floor covering panel 10*a* and the second floor covering panel 10*b* after a period of time.

In one aspect, this second floor covering panel 10*b* will have the adhesive composition applied thereto; in a further aspect the second floor covering panel 10*b* will not have the adhesive composition applied thereto. In a further aspect, the second floor covering panel 10*b* will have a different adhesive composition applied thereto.

In yet a further aspect, it is important that upon application and after drying, the adhesive composition not migrate substantially into the floor covering panel. However, as would be recognized by one of ordinary skill in the art, some penetration into the floor covering material substrate is necessary upon application of the wet composition to allow the adhesive composition to "grab" onto the substrate and enable the formation of a substantially non-refastenable bond. Still further, it is important that the adhesive composition not cause the floor covering panel to swell during use. That is, it is generally desired that the adhesive composition not contain ingredients that will wick into the floor covering panel material after the composition has dried. When an adhesive to panel bond is desired, it will be necessary for some of the adhesive composition to migrate into the second floor covering panel after the mating thereof in order to effect a non-refastenable bond. As such, when an adhesive to panel bond is desired, the dried adhesive composition should not migrate into the floor covering panel in a manner that causes swelling or other loss of integrity in the floor covering panel.

Still further, it is generally desirable that the adhesive composition remains fixed in the location at which it was applied. This "stay put" aspect of the adhesive composition is significant when the adhesive composition is selectively applied to the floor covering panels.

The present invention may also be utilized in conjunction with an invention relating to selective application of a barrier composition to a floor covering panel. The invention relating to this barrier composition is described in detail in a U.S. Patent Application filed concurrently herewith, the disclosure of which is incorporated herein in its entirety by this reference.

EXAMPLES

The following examples are put forth so as to provide those of ordinary skill in the art with a complete disclosure and description of how the apparatus and compositions claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.) but some errors and deviations should be accounted for. Unless indicated otherwise, parts are parts by weight, temperature is in ° F. (° C.) or is at ambient temperature, and pressure is at or near atmospheric.

Sample Adhesive Composition Formulations

| Composition 1 | |
|---|---|
| AAT-1311-3 (Advanced Adhesive Technologies, Dalton, GA) | 100 phr* |
| Acrylic polymer (Vinyl-acrylic blend with one polymer having a Tg of 30° C. at 60% by weight total polymer and second polymer having a Tg of 20° C. at 40% by weight total polymer.) | |
| NP-10 (nonylethanol phenol 10 mole ethoxylate) | 0.01-0.05 phr |
| Water | adjust to 50% solids |
| Sodium polyacrylate thickener | 0.15-0.60 phr |

| Composition 2 | |
|---|---|
| AAT-1311-4 (Advanced Adhesive Technologies, Dalton, GA) | 50 phr |
| Acrylic polymer (AAT-1311-3 as above) | 50 phr |
| Acrylic resin/tackifier (Ehylene-vinyl acetate copolymer latex and an acrylic latex. EVA has 20 to 25% ethylene monomer and 75-80% vinyl acetate.) | |
| NP-10 (nonylethanol phenol 10 mole ethoxylate) | 0.01-0.06 phr |
| Water | adjust to 50% solids |
| Sodium polyacrylate thickener | 0.1-0.50 |

*("parts per hundred resin")
Note that NP-10 and thickener amounts not exactly specified because amount needed will vary depending on other raw materials, viscosity desired and surface tension needed.

Application of Adhesive Composition to Laminate Flooring

A single bead of an adhesive composition was applied by spraying to the joint J (FIG. 4), which corresponds to the area marked 24 of one surface of a floor covering panel (FIGS. 2 and 3). A heat gun at 150° F. (65.6° C.) was aimed at the adhesive composition for approximately 30 seconds to provide an adhesive composition that was dry to the touch.

Figure 4:
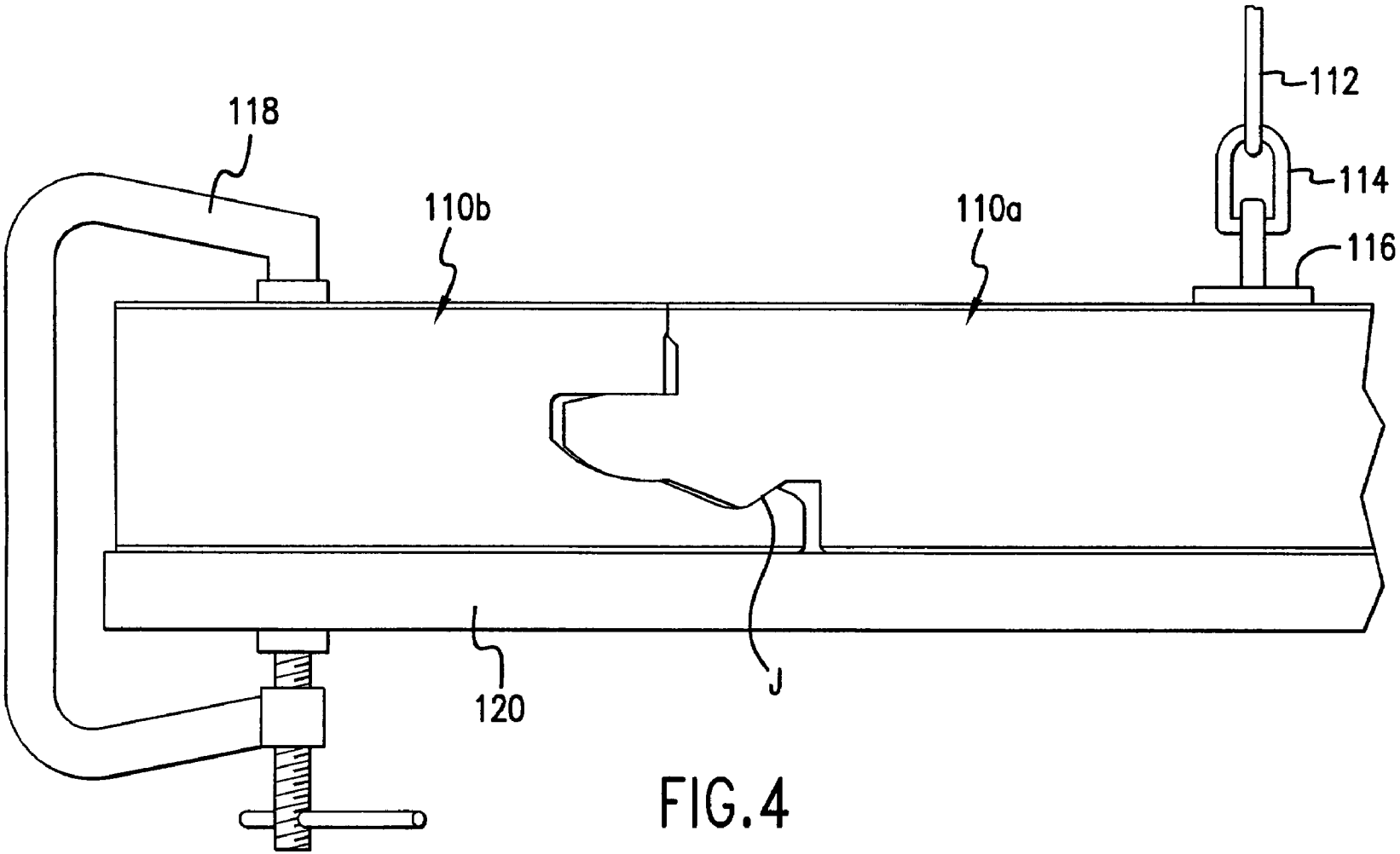
FIG. 4 is a schematic illustration of a testing fixture used to test seam strength associated with the floor covering panels of the invention.

Testing of Seam Strength (FIG. 4)

The strength of the adhesive bond at the joint J between the respective floor covering panels 110*a*, 110*b* resulting from the adhesive composition was tested using a "Hinge Test." In this test, the following equipment was used:

1. Floor covering panels 110*a*, 110*b* with high density fiberboard core
2. Saw (not shown) with a blade for cutting floor covering panels 110*a*, 110*b*
3. Tensile tester (not shown) with stationary surface in place of bottom grips
4. Cable 112 and clasp 114
5. Latch eye 116 and screws (not shown)
6. Clamps 118

The following procedure was used in the Hinge Test, as shown in FIG. 4:

1. Join floor covering panels together 110*a*, 110*b* with adhesive composition.
2. Cut joined floor covering panels 110*a*, 110*b* nine inches in a lengthwise direction and 6 inches across the width thereof. The joint J between the panels was four inches from the edge on the tongue side of the joint J.
3. Attach the latch eye 116 parallel to the joint J centered on the tongue side of the sample.
4. Grasp the free cable 112 end with the upper grips.
5. Clamp the shorter groove side to the stationary surface 120 on the tensile tester. The latch eye 116 must be aligned with the upper grips to pull directly vertical.
6. Attach the clasp 114 to the latch eye 116 and remove slackness in the cable 112 until there is a preload of about two pounds of tension.
7. Pull at 0.15 inches per minute until the joint J pops or breaks.
8. Record the maximum load required to pop or break the joint J.

Results of Hinge Test

The joint J to which the adhesive composition was applied did not fail until 16.6 lbs. of force was applied. Failure was by breakage of the core layer of the floor covering panel, not a failure of the adhesive bond. This signifies that the adhesive bond was strong and non-refastenable. The joint not having the adhesive composition applied failed after application of 9.6 lbs. of force. This shows that application of the adhesive compositions of the present invention provide a substantially stronger joint strength in floor covering materials.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A laminate floor covering panel, comprising:

a. a laminate floor panel comprising a plurality of layers and having a first generally planar surface, a second generally planar surface opposed to said first surface, a first side edge and an opposed second side edge, each respective side edge extending between said first and second surfaces, respectively, a first coupling member defined within the first edge of the panel and comprising a protrusion extending therefrom, a complementary second coupling member defined within the second edge of the panel and comprising a recess sized and shaped to receive said protrusion therein; and b. a self activating adhesive composition having an open time of at least about one month selectively applied to at least a portion of at least one of the first and second coupling members.

2. The laminate floor covering panel of claim 1, further comprising a first and a second one of said floor covering panels, respectively, the first coupling member of the first panel being received within the second coupling member of the second panel, and wherein the adhesive composition is positioned between the respective first and second coupling members of the two panels and forms an adhesive bond there between.

3. The laminate floor covering material of claim 2, wherein the adhesive composition forms a substantially non-refastenable bond after about 48 hours of connective attachment.

4. The laminate floor covering material of claim 2, wherein the adhesive bond is substantially separable prior to about 48 hours of connective attachment.

5. The laminate floor covering panel of claim 2, wherein the first coupling member of the first panel engages the second coupling member of the second panel along a plurality of contact zones defined between the respective coupling members.

6. The laminate floor covering panel of claim 2, wherein the first coupling member of the first panel engages the second coupling member of the second panel along at least one contact zone defined between the respective coupling members.

7. The laminate floor covering panel of claim 6, wherein the adhesive composition is applied to a selected contact zone and does not otherwise extend to any portions of the respective coupling members outside of the selected contact zone.

8. The laminate floor covering panel of claim 7, wherein the selected contact zone comprises a locking structure for preventing substantial separation of the first panel from the second panel in a direction perpendicular to the respective side edges of the panels and parallel to the respective surfaces thereof.

9. The laminate floor covering panel of claim 8, the second coupling member further comprising an upper lip defined within the second side edge between the recess of the second coupling member and the first surface of the panel, and a lower lip defined within the second side edge between said recess and the second surface of the panel, and a detent defined within said lower lip.

10. The laminate floor covering panel of claim 9, wherein said locking structure further comprises a rib extending from the protrusion of the first coupling member and the detent defined within the lower lip of the second coupling member, the rib being received within the detent and contacting the detent along the selected contact zone.

11. The laminate floor covering panel of claim 10, wherein the selected contact zone is substantially planar.

12. The laminate floor covering panel of claim 11, wherein the selected contact zone forms an acute angle with respect to the second surface of the respective panels, said acute angle being measured from the second surface to the contact zone in a counter-clockwise direction.

13. The laminate floor covering panel of claim 1, wherein the adhesive composition comprises a contact adhesive.

14. The laminate floor covering panel of claim 1, wherein the adhesive composition comprises an adhesive polymer comprising one or more of: polychloroprene, polyurethane, styrene-isoprene copolymer, styrene-butadiene copolymer, a polyimide, polyvinyl chloride, nitrocellulose, polyisoprene, acrylonitrile-butadiene-isoprene terpolymer, butadiene-methacrylonitrile copolymer, polyethylene-vinyl acetate copolymer, or an acrylic polymer.

15. The laminate floor covering panel of claim 1, wherein the at least one adhesive composition comprises an aqueous dispersion of an acrylic polymer.

16. The laminate floor covering panel of claim 15, wherein the acrylic polymer is derived from one or more monomers comprising: methyl acrylate, ethyl acrylate, butyl acrylate, cyclohexyl acrylate, 2-ethylhexyl acrylate, t-octyl acrylate, dodecyl acrylate, and octadecyl acrylate.

17. The laminate floor covering panel of claim 15, wherein the acrylic polymer is derived from one or more monomers comprising: methyl, acrylate, ethyl acrylate, butyl acrylate, or 2-ethyihexyl acrylate.

18. The laminate floor covering panel of claim 1, wherein the adhesive composition has an open time of at least about six months.

* * * * *